US010808906B2

(12) United States Patent
Colombel et al.

(10) Patent No.: US 10,808,906 B2
(45) Date of Patent: Oct. 20, 2020

(54) METHOD FOR OBTAINING A LUMINOUS DEVICE THE TURNED-OFF ASPECT OF WHICH IS DIFFERENT FROM THE TURNED-ON ASPECT

(71) Applicant: VALEO VISION, Bobigny (FR)

(72) Inventors: Jean-Marc Colombel, Angers (FR); Erwan Faoucher, Angers (FR); Francois Gratecap, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/129,363

(22) Filed: Sep. 12, 2018

(65) Prior Publication Data

US 2019/0078751 A1 Mar. 14, 2019

(30) Foreign Application Priority Data

Sep. 12, 2017 (FR) ..... 17 58449

(51) Int. Cl.
*F21S 43/20* (2018.01)
*F21S 43/14* (2018.01)
(Continued)

(52) U.S. Cl.
CPC ..... *F21S 43/26* (2018.01); *F21S 41/30* (2018.01); *F21S 43/14* (2018.01); *F21S 43/19* (2018.01); *F21S 43/50* (2018.01); *F21V 11/14* (2013.01)

(58) Field of Classification Search
CPC .. F21S 43/26; F21S 43/14; F21S 43/50; F21S 41/30; F21S 43/19; F21V 11/14;
(Continued)

(56) References Cited

U.S. PATENT DOCUMENTS 4,241,388 A * 12/1980 Green ..... F21S 43/40 362/516
4,383,290 A * 5/1983 Binder ..... F21S 41/337 362/518
(Continued)

FOREIGN PATENT DOCUMENTS

CN 107091447 A 8/2017
EP 1 835 226 A1 9/2007
(Continued)

OTHER PUBLICATIONS

French Preliminary Search Report dated Feb. 22, 2018 in French Application 17 58449, filed on Sep. 12, 2017 (with English Translation of Categories of cited documents).

*Primary Examiner* — Kevin Quarterman
(74) *Attorney, Agent, or Firm* — Oblon, McClelland, Maier & Neustadt, L.L.P.

(57) ABSTRACT

A method for obtaining a luminous device the turned-on aspect of which is different from the turned-off aspect, the device including a mask that is able to be partially passed through by light, one or more light sources, and a closing outer lens that is placed downstream of the mask. The one or more light sources and the mask are arranged with respect to one another so that the mask directly or indirectly receives the light rays emitted by the one or more light sources and so that only some of these emitted light rays pass through the mask. The method includes a step of arranging the one or more light sources in the luminous device in number and in power so that the light rays exiting from the luminous device form a signalling light beam.

12 Claims, 3 Drawing Sheets

(51) Int. Cl.

| | |
|---|---|
| ***F21V 11/14*** | (2006.01) |
| ***F21S 43/50*** | (2018.01) |
| ***F21S 41/30*** | (2018.01) |
| ***F21S 43/19*** | (2018.01) |

(58) Field of Classification Search
CPC . F21V 5/04; F21V 11/00; F21V 14/08; F21K 9/20; F21K 9/60; F21Y 2115/10
See application file for complete search history.

(56) References Cited

U.S. PATENT DOCUMENTS

| | | | | |
|---|---|---|---|---|
| 4,811,179 | A * | 3/1989 | Komatsu | F21V 11/04 200/315 |
| 4,855,877 | A * | 8/1989 | Otaka | B60Q 1/2607 362/509 |
| 5,128,839 | A * | 7/1992 | Kato | B60Q 1/2607 362/268 |
| 5,455,747 | A * | 10/1995 | Aoyama | B60Q 1/2607 362/545 |
| 6,409,371 | B2 * | 6/2002 | Aikawa | B60Q 1/2607 156/297 |
| 2009/0290336 | A1 | 11/2009 | Senzaki et al. | |
| 2017/0241613 | A1 | 8/2017 | Faoucher et al. | |

FOREIGN PATENT DOCUMENTS

| | | | |
|---|---|---|---|
| EP | 3 208 528 | A1 | 8/2017 |
| WO | WO 2015/090069 | A1 | 6/2015 |

* cited by examiner

METHOD FOR OBTAINING A LUMINOUS DEVICE THE TURNED-OFF ASPECT OF WHICH IS DIFFERENT FROM THE TURNED-ON ASPECT

The present invention relates to a method for obtaining a luminous motor-vehicle device. This luminous device may have a signalling function. More particularly, the invention relates to a method for obtaining a luminous device the aspect of which, when it is turned off, also called its turned-off aspect, is different from its aspect when it is turned on, also called its turned-on aspect.

In the field of the lighting of motor vehicles, manufacturers are seeking not only to improve the signalling function of luminous devices but also to add other technical and/or aesthetic particularities thereto in order to make the users of the vehicle entirely happy.

Among these particularities, manufacturers have added what is called a "ghost effect" technology to luminous devices. This technology consists in giving the luminous device a turned-on aspect that is unexpectedly different from its turned-off aspect. For example, when the luminous device is turned off, it may have a plain glossy black aspect that gives the user the impression that when the device is turned on the light beam will be uniform. However, when the luminous device is turned on, a luminous pattern appears, while nonetheless allowing the luminous device to perform its signalling function. This pattern may be purely decorative, include a logo of the manufacturer, or even perform a signalling function, such as that of a night-time position light.

There are various ways of producing a luminous device that performs a signalling function and that, at the same time, creates what is called a "ghost effect". Nevertheless, existing solutions could still be improved on, in particular in terms of their cost and the adaptability of the "ghost effect" luminous device to various structures.

Thus, one objective of the invention is to provide a method for obtaining a luminous device that performs at least one signalling function and at the same time creates a ghost effect.

To this end, the invention relates to a method for obtaining a luminous device the turned-on aspect of which is different from the turned-off aspect, said device including:

- a mask that is able to be partially passed through by light, one or more light sources, and a closing outer lens that is placed downstream of the mask,
- the one or more light sources and the mask being arranged with respect to one another so that the mask directly or indirectly receives the light rays emitted by the one or more light sources and so that only some of these emitted light rays pass through the mask.

According to the invention, the method comprises a step of arranging the one or more light sources in number and in power in the luminous device so that the light rays exiting from the luminous device form a signalling light beam.

In other words, for a mask and closing outer lens that transmit light rays to a given extent, the light beam depends on the arrangement of the light sources used to perform the signalling function. Thus, it is enough to know the characteristics of the exiting light beam and to adapt the configuration of the light sources accordingly.

Thus, the method proposed by the invention allows, with the same elements, in particular the same light sources, not only a ghost effect to be created, by virtue of its mask, which lets the light rays that reach it partially pass through, but also at least one signalling function to be performed. Moreover, this method therefore allows the light sources and parts used to be decreased. The method is thus less complex and less expensive.

The adaptation of the light sources may be in terms of their quantity, in terms of their individual power, in terms of their position in the luminous device and optionally with respect to optical forming parts, for example lenses, and in terms of their power supply.

According to the invention, said signalling function may be in accordance with national or regional regulations in the country in which the luminous device is manufactured and/or sold, for example in Europe, in particular in the European Union.

The method according to the invention may optionally have one or more of the following features:

- the method comprises the steps of:
  - determining the percentage of light rays passing through the mask,
  - determining the percentage of light rays passing through the closing outer lens,
  - determining the value of the light flux required for the light beam exiting from the luminous device so that the light beam is a signalling light beam,
  - determining the initial flux value required upstream of the mask so that the value of the required light flux is equal to the initial value multiplied by the percentage of light rays passing through the mask, then by the percentage of light rays passing through the closing outer lens,
  - choosing the number and power of the one or more light sources so that the flux emitted upstream of the mask is equal to the initial value;

this is a simple manner of carrying out the method according to the invention;

- the luminous device comprises a plurality of light sources, the method comprising the steps of:
  - determining the percentage of light rays passing through the mask,
  - determining the percentage of light rays passing through the closing outer lens,
  - considering a measurement grid associating required light intensities with points of determined coordinates,
  - determining, for each of the points of determined coordinates, the initial value of the light intensity required in at least one given position in the luminous device and upstream of the mask, so that the value of the light intensity required for each of these points of determined coordinates is equal to the initial value multiplied by the percentage of light rays passing through the mask, then by the percentage of light rays passing through the closing outer lens, and
  - choosing the number and the power of the light sources to be associated with each of the given positions so that the light intensity in this given position is equal to the initial value,
  - orienting the light sources in each of the given positions so that they emit toward the points of determined coordinates that are associated therewith,
  - connecting the light sources in the luminous device so that they are able to be driven independently of one another;

this is a simple manner of carrying out the method according to the invention with a preciser distribution of the intensities;

- when the mask is formed by a scattering film laminated to the back face of a transparent, or translucent, nonscattering plate, the step of determining the percentage (X) of light rays passing through the mask takes into account the percentage of light rays passing through the plate and the percentage of light rays passing through the film;

when the one or more light sources are associated with an optic that deviates the light rays emitted by the one or more light sources toward the mask, the method also comprises:

a step of determining, the percentage of light rays deviated, the step of determining, for each of the points of determined coordinates, the initial value of the light intensity required in at least one given position in the luminous device and upstream of the mask being carried out so that the value of the light intensity required for each of these points of determined coordinates is equal to the initial value multiplied by the percentage of light rays deviated, and then multiplied by the percentage (X) of light rays passing through the mask, then by the percentage (Y) of light rays passing through the closing outer lens;

the optic may for example be a reflector or a lens, or a combination of at least one reflector and of at least one lens.

In the present description, the light sources may comprise at least one light-emitting diode, also called more concisely an LED.

Another subject of the invention is a luminous device the turned-on aspect of which is different from the turned-off aspect, said device being obtained using the method according to the invention.

According to the invention, the luminous device may include a mask that is able to be partially passed through by light, one or more light sources and a closing outer lens that is placed downstream of the mask. The or at least one of the light sources and the mask are arranged with respect to each other so that the mask directly or indirectly receives the light rays emitted by the one or more light sources and so that only some of these light rays pass through the mask. Furthermore, the one or more light sources are arranged so that the light rays exiting from the luminous device form a signalling light beam.

Thus, on the one hand, by virtue of the presence of the mask, a luminous device that produces a ghost effect when it passes from the turned-off state to the turned-on state and vice versa is obtained. Specifically, in the turned-off state of the luminous device, the portions blocked by the mask appear to be inactive zones, i.e. zones that are expected to keep the same aspect when the luminous device is turned on. However, given the particularity of the mask, in the turned-on state of the luminous device, the blocked portions become luminous zones unexpectedly. Thus, the turned-on aspect of the luminous device is different from its turned-off aspect. The luminous device according to the invention indeed creates what is called a "ghost effect".

Furthermore, because of the arrangement of the one or more light sources, the luminous device performs at least one signalling function.

The luminous device may comprise light sources having various functions, for example a first source performing the signalling function and a second source performing the decorative function.

The luminous device according to the invention may optionally have one or more of the following features:

the luminous device comprises a plurality of light sources, the light sources having an arrangement and connections in the luminous device allowing them to be driven independently of one another;

the one or more light sources are arranged facing the mask; in this case, the mask directly receives the light rays emitted by the light sources;

alternatively or in addition to the preceding paragraph, the mask receives light rays reflected by optical forming parts; thus, the mask receives the light indirectly;

the mask receives the light rays emitted by the light sources via a light guide;

the mask comprises a plate that is able to be partially passed through by light, said plate comprising a front face that is visible from the exterior and a back face that is opposite to the front face, and the mask also comprises a coating placed on the back face of the plate and comprising at least one apertured zone covered by the plate, the mask and the or at least one of the light sources being arranged so that the apertured zone is visible from the exterior when the luminous device is turned on;

according to the preceding paragraph, the coating may be reflective; alternatively, the coating is opaque and non-reflective;

the plate may be translucent and the coating may be scattering;

the luminous device comprises a segmenting part including one or more through-cavities, and one or more light sources upstream of the segmenting part, the luminous device being arranged so that the one or more through-cavities directly or indirectly receive the light of at least one light source, the mask blocking at least one through-cavity of the segmenting part; thus, in the turned-off state of the luminous device, the one or more cavities blocked by the mask appear to be inactive zones, i.e. zones that are expected to keep the same aspect when the luminous device is turned on; however, given the particularity of the mask, in the turned-on state of the luminous device, the one or more blocked cavities become luminous zones unexpectedly;

the segmenting part comprises a plurality of through-cavities, the mask including at least one apertured zone, the mask and the segmenting part being arranged with respect to each other so that the apertured zone is placed facing at least one through-cavity;

the luminous device comprises a plurality of light sources, the segmenting part comprising a plurality of through-cavities, said luminous device being arranged so that each through-cavity directly or indirectly receives the light of at least one separate light source;

the mask is made from a scattering and translucent material; in particular, in the case where the light sources are at a distance from the mask, the translucent material lets light pass but does not allow an object seen through this material to be clearly distinguished;

according to the preceding paragraph, the material from which the mask is made is dark; for example, the mask is made from a polymer from the family of the polycarbonates or of the polyethersulfones, additives giving the mask its dark hue; the mask may also be made from any material that is transparent and potentially injection mouldable or thermoformable, for example from a polymer of the polymethyl-methacrylate or polyurethane family, to which additives giving the mask its dark hue may be added;

the mask is made from a material that lets pass 5 to 20% of the light that reaches it;

the signalling light beam performs the function of a stop light; the stop light indicates when the vehicle is braking;

the signalling light beam performs the function of a night-time position light.

Of course, the light beam may perform other luminous functions, such as the function of a fog light, of a reversing light, of a position light, of a direction indicator and of a daytime running light.

Other innovative features and advantages will become more clearly apparent from the following description, which is given by way of completely nonlimiting indication with reference to the appended drawings, in which.

Figure 4:
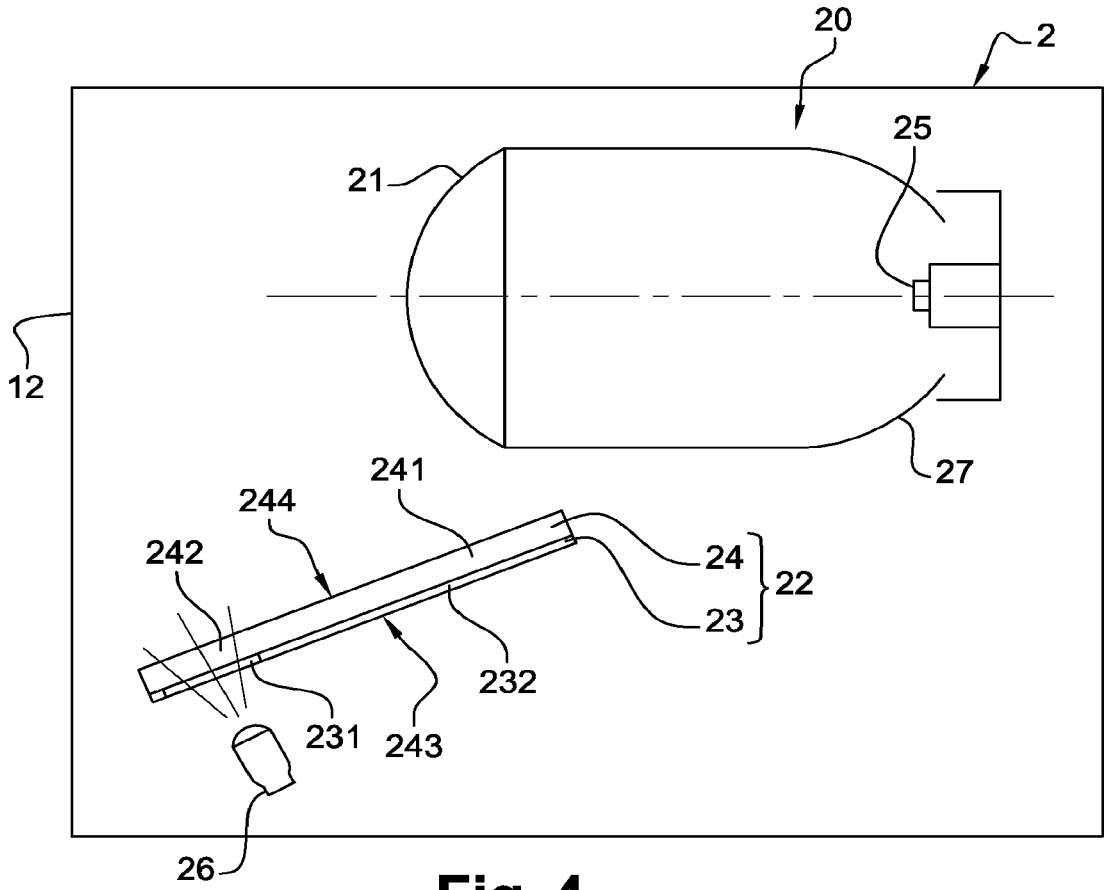
Figure 5:
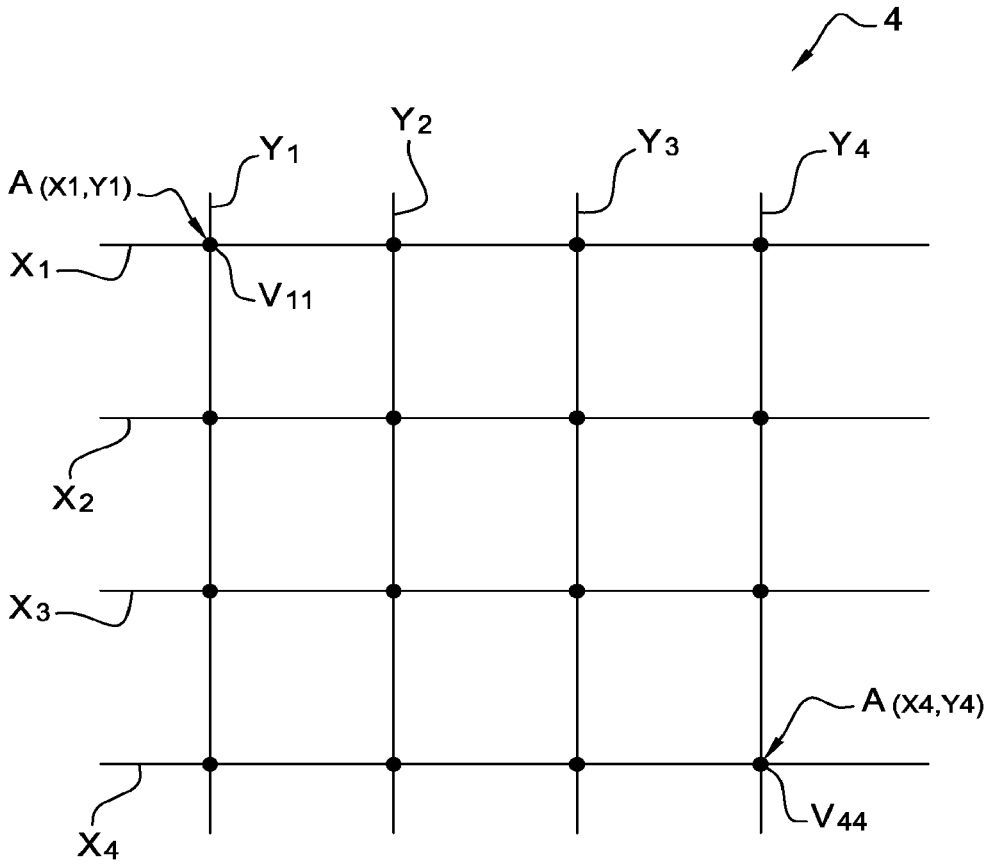

FIG. 4 schematically shows a side view of a second embodiment of a luminous device obtained using an example of a method according to the invention;

FIG. 5 schematically shows a measurement grid associating required light intensities with points of coordinates present on the grid.

Unless otherwise indicated, in the present description, the terms "front", "back", "lower", and "upper" refer to the direction of emission of light out of the corresponding luminous device. The terms "upstream" and "downstream" refer to the path travelled by the rays from the light source to the point that they exit from the luminous device. Moreover, the terms "horizontal", "vertical" or "transverse" are defined with respect to the orientation of the luminous device once it is mounted in the vehicle.

Figure 1:
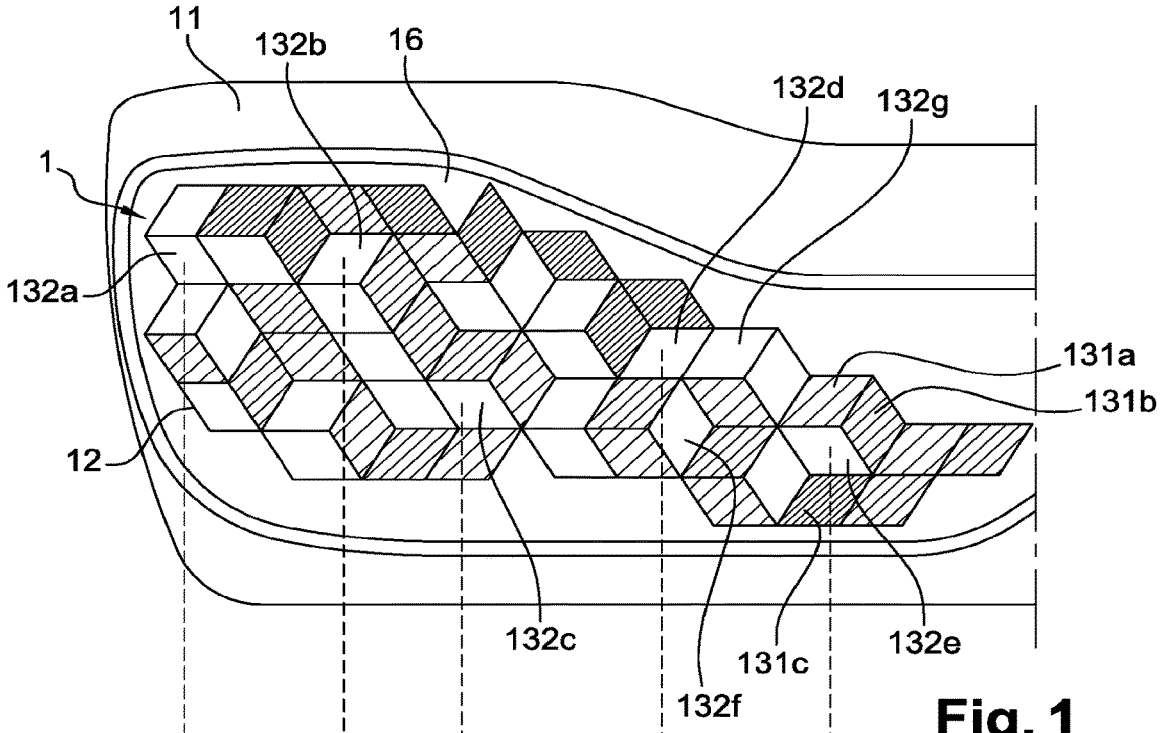
FIG. 1 shows a front view of a first embodiment of a luminous device obtained using an example of a method according to the invention.

With reference to FIG. 1, a luminous device 1, according to a first embodiment, is installed in a casing 11 that is intended to be installed in a location dedicated to the luminous device 1 in a vehicle.

Generally, according to the invention, this casing 11 may be located at the front or at the rear depending on the signalling function carried out by the luminous device 1.

In the illustrated example, the casing is installed at the rear of the vehicle.

The luminous device 1 comprises a closing outer lens 12 that forms a barrier with the exterior and that lets light pass.

In the illustrated example, the closing outer lens 12 is made from a transparent material. The term "transparent" is understood to mean the character of an element that lets light pass and that allows the shape of an object seen through this element to be clearly distinguished.

In this example, the transmittance of the closing outer lens 12 is higher than 80%, in particular this transmittance is about 89%.

Figure 3:
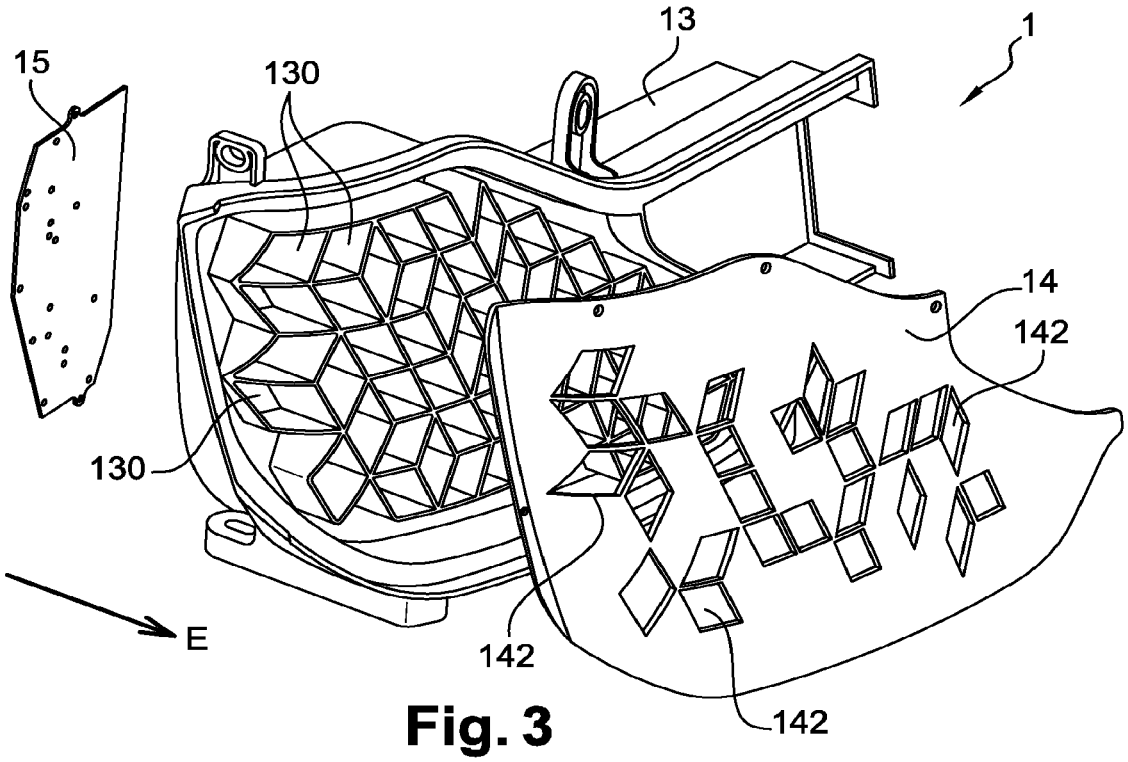
FIG. 3 shows an exploded perspective view of the luminous device of FIG. 1.

With reference to FIG. 3, the interior of the luminous device 1 is shown. The luminous device 1 comprises a segmenting part 13, a mask 14 and a plurality of printed circuit boards 15. For the sake of clarity, a single printed circuit board 15 has been illustrated. The printed circuit boards 15 are fastened to the back of the segmenting part 13 whereas the mask 14 is fastened to the front of the same part.

The segmenting part 13 comprises a plurality of through-cavities 130 that are placed beside one another. In the illustrated example, each through-cavity 130 has the shape of a rhombus. Of course, in another example embodiment, the through-cavities could have other shapes and orientations.

Furthermore, in the illustrated example, the segmenting part 13 is covered with a reflective coating.

Light sources (not illustrated in the figures) are arranged on the printed circuit board 15 so that, once this board is fastened to the segmenting part 13, at least one light source is placed facing a corresponding through-cavity 130. In this example, each light source consists of two LEDs that emit light toward a corresponding through-cavity.

Moreover, according to the invention, and in this example, the light sources have an arrangement and connections in the luminous device allowing them to be driven independently of one another, for example using a driving device (also called a driver). Given that each cavity 130 receives at least one light source and that these light sources are managed by the driving device, it is possible to adjust the illumination of each of the cavities, whether it be blocked or not by the mask. The driving device may be mounted in or on the luminous device 1 or even be arranged in the vehicle at a distance from the luminous device.

In addition, the intensity of each of the light sources may be adjusted independently of the others. In this way, it is possible to drive the light sources so that each through-cavity 130 is illuminated with the desired intensity.

The mask 14 is installed in front of the segmenting part 13. In the illustrated example, the mask 14 is screwed to the segmenting part 13 but other fastening means may be envisaged. Thus, the mask 14 directly receives the light rays emitted by the light sources.

Apertured zones 142 are produced in the mask 14 so that when the mask 14 is fastened to the segmenting part 13, each apertured zone 142 is located facing a corresponding through-cavity 130.

According to the invention and optionally, each apertured zone 142 is covered with a transparent element, i.e. an element that lets light pass and that allows an object seen through this element to be clearly distinguished. For example, the transparent element is a part made of polymethyl methacrylate (PMMA) or Plexiglas®. Alternatively, a transparent second mask of smooth aspect may be laminated to the dark scattering mask. This transparent element may in particular have the shape of a prism.

According to the invention, as here, each apertured zone may have the same shape and the same orientation as those of the corresponding through-cavity 20.

In the illustrated example, the mask 14 is made from a material that lets 10% of light pass. In addition, this material is scattering and translucent. In particular, the scattering material spreads light uniformly for an observer. Moreover, by way of example, in the case where the light sources are located at a distance from the mask, the translucent material lets light rays pass but does not allow the outlines of an object seen through this material to be clearly distinguished.

Moreover, the mask 14 may have a dark or deep colour. In particular, in this example, the mask 14 is black in colour. Thus, by virtue of the black or dark hue of the mask, only the cavities 130 facing the apertured zones, which are called non-blocked cavities 132, are visible from the exterior, whereas the cavities 131 blocked by the mask 14 are not.

The closing outer lens 12 (not illustrated in FIG. 2) is placed in front of the mask 14. The luminous device 1, such as placed, emits a light beam in a direction of light emission, in the direction E illustrated in FIG. 3.

Because of the presence of the mask 14, in the turned-off state of the luminous device 1, the latter gives the user the impression that only the locations of the non-blocked visible cavities 132 will be illuminated and that the other locations, perceived to be black or dark, will keep the same aspect when the luminous device 1 is turned on.

When the device is turned on, the blocked cavities 131 are also unexpectedly visible because the mask lets light partially pass and because each cavity receives at least one light source. The illustrated luminous device according to the first embodiment therefore creates a "ghost effect".

Parallelly, the luminous device 1, when it is turned on in a given way, performs a signalling function, and does so by virtue of the method according to the invention, details of which will be given below. In this example, the signalling function performed is the signalling function of a rear light of a vehicle. This function may be a night-time-position-light function, or even a stop-light function or other luminous functions, such as the function of a fog light, of a reversing light, of a position light, of a direction indicator and of a daytime running light.

An example of a luminous pattern 16 performing a signalling function is shown in FIG. 1. As explained above, each through-cavity 130 may be illuminated differently because the intensity and illuminance of each of the light sources may here be adjusted independently of the others. Thus, the luminous pattern comprises through-cavities 130 the light intensities of which are different.

It will be noted that in the illustrated example the through-cavities 130 forming part of the luminous pattern 16 are, in this example, the cavities 131 blocked by the mask 14. In order to make FIG. 1 easier to read, dashed arrows I have been drawn in order to show the correspondence between the cavities 130 in FIG. 1 and the apertured zones 142 of the mask in FIG. 2.

Figure 2:
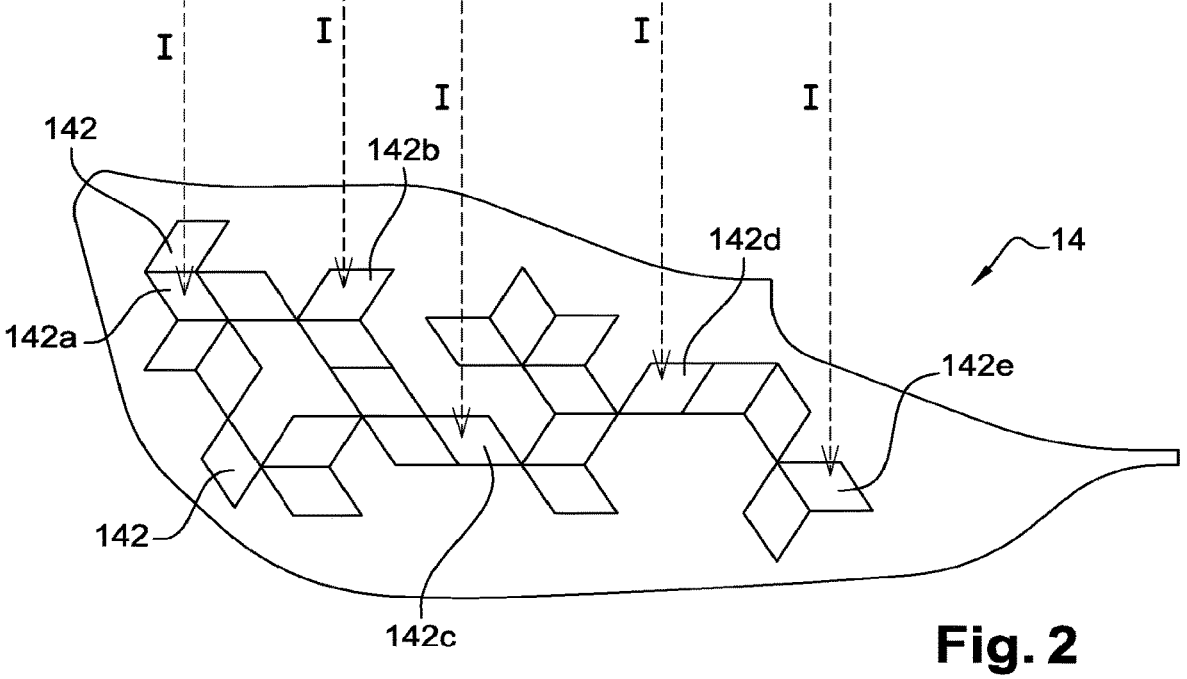
FIG. 2 shows a front view of a mask forming part of the luminous device of FIG. 1.

FIGS. 1 and 2 show cavities 132 that are not blocked by the mask, i.e. cavities that are located facing apertured zones 142 of the mask 14, which are not illuminated. A few of these cavities have been referenced from left to right in FIG. 1 132*a*, 132*b*, 132*c*, 132*d* and 132*e*. The latter are located facing the apertured zones 142*a*, 142*b*, 142*c*, 142*d* and 142*e*, respectively.

In contrast, certain blocked cavities 131 are illuminated but differently. For example, three illuminated cavities 131*a*, 131*b*, 131*c* each having a different light intensity encircle the non-blocked and non-illuminated cavity 132*e* located most to the right in FIG. 1. The illuminated cavity 131*a* located above the cavity 132*e* has the lowest light intensity among the illuminated three. The illuminated cavity 131*b* located beside the cavity 132*e* has a medium intensity, whereas the one 131*c* below has a high intensity.

As here, it is possible to arrange for one or more blocked but non-illuminated cavities, for example, such is the case of the cavity 132*f* located below the cavities 132*d* and 132*g* in FIG. 1.

According to the invention, the luminous device may be arranged so as to be able to make it possible to control or to control the light sources in a plurality of turn-on and turn-off combinations, so as:

- to modify the illuminated pattern while preserving the same signalling function,
- to modify the illuminated pattern in order to perform various additional functions, such as a direction-indicator function and/or a welcome scenario when the vehicle is unlocked and opened.

With reference to FIG. 4, the luminous device 2, according to a second embodiment, comprises a mask 22 and a main light source 25. In this example, the luminous device is a vehicle headlamp.

Here, the luminous device 2 also comprises a conventional optical module 20 comprising an elliptical reflector 27 and a optical forming part 21, for example a lens 21. The reflector reflects the light rays from the light source 25 toward the optical lens 21, which directs these light rays toward the closing outer lens 12 in order to form an illuminating beam.

The mask 22 comprises a plate 24 that is able to be partially passed through by the light rays. In this example, the plate 24 is made of the same material as that presented in FIGS. 1 and 2. Precisely, the plate 24 is made of a scattering translucent material of dark colour. The plate 24 has a front face 244 that is visible from the exterior and a back face 243 that is opposite to the front face 244.

The mask 22 also comprises a reflective coating 23 that adheres to the front face 244 of the plate 24.

In the example illustrated in FIG. 4, the reflective coating 23 comprises an apertured zone 231. This apertured zone 231 may have the shape of the insignia of the model of the vehicle or of the manufacturer. The apertured zone 231 may be produced by cutting the coating 23, for example via a partial and/or complete laser ablation.

According to the invention and in another example embodiment, the reflective coating 23 may be replaced by an opaque and nonreflective coating, for example a coat of opaque paint. This coating may include at least one apertured zone similar to that shown in FIG. 4.

A secondary light source 26 is installed facing the apertured zone 231 in order to make it visible when this source 26 is turned on.

In the illustrated example, the secondary light source 26 is turned on at the same time as the main light source 25 and is also turned off at the same time as it.

On the front surface of the mask 22, which therefore corresponds to the front surface of the plate 24, a first portion 241 and a second portion 242 may be seen. The first portion 241 of the mask 24 is superposed on the non-apertured section 232 of the coating 23. The second portion 242 faces the apertured zone 231.

When the secondary light source 26 is turned on, the second portion 242 of the plate 24 appears illuminated whereas the first portion 241 preserves the dark aspect conferred by the material from which this plate 24 is made.

When the secondary light source 26 is turned off, the back face 244 of the plate 24 has a uniform dark aspect given that the plate 24 is made of a dark scattering material and that the reflective coating 23 is located in front of the plate 24. Of course, it is assumed that the area of the apertured zone 231 of the coating 23 is a minority of the total area of the same coating 23.

Thus, turning on the secondary light source 26 allows a pattern to be seen on a dark background. The aspect of the headlamp, i.e. of the luminous device 2 according to the second embodiment, when it is turned on, i.e. when the main and secondary light sources 25, 26 are turned on, is thus different from the aspect of the headlamp when it is turned off, i.e. when the main and secondary light sources 25, 26 are turned off.

In parallel, the luminous device 2 in the turned-on state, for example according to the first particular case, performs a luminous function, for example a direction-indicator function, and does so by virtue of the method according to the invention, details of which will be given below.

According to another example embodiment, the luminous device is a rear vehicle light and comprises a mask similar to that described with reference to FIG. 4 except that the coating includes a plurality of apertured zones placed so as to form a luminous pattern. Light sources are positioned facing apertured zones so that when the luminous device is turned on, the luminous pattern is visible and, at the same time, performs a signalling function. For example, the luminous pattern may be identical to that described in FIG. 1.

The method for obtaining a luminous device according to the first or second embodiment will now be described.

Firstly, for a luminous device 1 or 2 having a turned-on aspect different from the turned-off aspect, for example such as that illustrated in FIG. 1 or in FIG. 4, the percentage of light rays passing through the mask 14 or 22 and the percentage of light rays passing through the closing outer lens 12 is determined.

Next, the value of the light flux required for the light beam exiting from the luminous device 1 or 2 is determined so that the light beam is a signalling light beam. For example, the value of the required light flux may be set by regional or national regulations so that the light beam is acceptable as a signalling light beam. The signalling function may be a night-time-position-light function, or even a stop-light function.

Next, what the initial value of the light flux upstream of the mask 14 or 22 is to be is determined depending on the value of the required light flux. In other words, the value of the required light flux is equal to the initial value multiplied by the percentage of light rays passing through the mask 14 or 22, then by the percentage of light rays passing through the closing outer lens 12. Knowing the last two data and the value of the required light flux, it is thus possible to deduce the initial value of the light flux upstream of the mask 14 or 22.

On the basis of the obtained initial value, the number and the power of the light sources are chosen so that the flux emitted upstream of the mask 14 or 22 is equal to the initial value. Here, the flux emitted upstream of the mask 14 or 22 is the sum of the light fluxes of all the light sources.

Thus, by following the above-presented steps of the method, a light beam exiting from the luminous device 1 or 2 is obtained that performs a signalling function.

According to the invention and in this example, it is possible, alternatively or in addition to the above-presented steps, to determine the percentage of light rays passing through the mask 14 or 22 and the percentage of light rays passing through the closing outer lens 12 in the case where these percentages have not been determined.

Next, a measurement grid associating required light intensities with points of determined coordinates is considered. An example of a measurement grid 4 is illustrated in FIG. 5. The measurement grid 4 includes vertical axes $Y_m$ and horizontal axes $X_n$ that cross one another at points $A(X_n, Y_m)$ of coordinates. For the sake of clarity and simplicity, in the illustrated schematic, n and m are equal to 4. At each of these points of coordinates the required light intensity $V_{nm}$ of the light beam at this point is displayed. By way of example, the measurement grid and the value of the required light intensities are set by regulation.

On the basis of this measurement grid 4, for each of the points $A(X_n, Y_m)$ of determined coordinates, the initial value of the light intensity at a corresponding position located upstream of the mask 14 or 22 in the luminous device 1 or 2 is determined.

It will be noted that for each of the points $A(X_n, Y_m)$ of determined coordinates, the value of the required light intensity is equal to the initial value multiplied by the percentage of light rays passing through the mask, then by the percentage of light rays passing through the closing outer lens. Thus, since the two percentages and the value of the required light intensity are known for each point of coordinates, it is possible to deduce the initial light-intensity value required at a corresponding position upstream of the mask 14 or 22, in the luminous device 1 or 2.

Next, the number and the power of the light sources to be associated with each of the given positions are determined so that the light intensity in this given position is equal to the initial value.

Afterwards, the light sources are oriented in the each of the given positions so that they emit toward the points of determined coordinates that are associated therewith.

Moreover, the light sources in the luminous device 1 or 2 are connected so that they are able to be driven independently of one another.

Thus, according to the method, for a given transmittance of the mask and of the closing outer lens, it is possible to arrange the light sources so that the luminous device 1 or 2 performs not only a signalling function but also creates a technical effect called a "ghost effect".

The invention claimed is:

1. A luminous device, wherein the luminous device includes a mask partially passed through by light, one or more light sources and a closing outer lens placed downstream of the mask, the one or more light sources and the mask are arranged with respect to each other so that the mask directly or indirectly receives the light rays emitted by the one or more light sources and only some of the light rays pass through the mask, and the one or more light sources are arranged so that the light rays exiting from the luminous device form a signalling light beam, wherein the luminous device comprises a segmenting part, separate from the mask and placed upstream of the mask, including one or more through-cavities, the one or more light sources are upstream of the segmenting part, the luminous device being arranged so that the one or more through-cavities directly or indirectly receive the light of at least one light source, and the mask blocks at least one through-cavity of the segmenting part.

2. The luminous device according to claim 1, wherein the luminous device comprises a plurality of light sources and the plurality of light sources have an arrangement and connections in the luminous device allowing them to be driven independently of one another.

3. The luminous device according to claim 1, wherein the one or more light sources are arranged facing the mask.

4. The luminous device according to claim 1, wherein the mask receives light rays reflected by optical forming parts.

5. The luminous device according to claim 1, wherein the segmenting part comprises a plurality of through-cavities, and the mask includes at least one apertured zone and the mask and the segmenting part are arranged with respect to each other so that the apertured zone is placed facing at least one through-cavity.

6. The luminous device according to claim 1, wherein the luminous device comprises a plurality of light sources, the segmenting part comprises a plurality of through-cavities, and the luminous device is arranged so that each through-cavity directly or indirectly receives the light of at least one separate light source.

7. The luminous device according to claim 1, wherein the mask is made from a scattering and translucent material.

8. The luminous device according to claim 1, wherein the mask is made from a material that lets pass 5 to 20% of the light that reaches the mask.

9. The luminous device according to claim 1, wherein the signalling light beam performs as a stop light.

10. The luminous device according to claim 1, wherein the signalling light beam performs as a night-time position light.

11. The luminous device according to claim 2, wherein the one or more light sources are arranged facing the mask.

12. The luminous device according to claim 2, wherein the mask receives light rays reflected by optical forming parts.

* * * * *